US012680558B1

(12) United States Patent
Casati et al.

(10) Patent No.: US 12,680,558 B1
(45) Date of Patent: Jul. 14, 2026

(54) BLOWER ASSEMBLY WITH LOCATING FEATURES FOR AN APPLIANCE

(71) Applicant: Haier US Appliance Solutions, Inc., Wilmington, DE (US)

(72) Inventors: Enzo Casati, Austin, TX (US); Otto Armando Ramirez, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 19/329,979

(22) Filed: Sep. 16, 2025

(51) Int. Cl.

| | |
|---|---|
| ***F04D 29/62*** | (2006.01) |
| ***D06F 58/02*** | (2006.01) |
| ***D06F 58/20*** | (2006.01) |
| ***F04D 17/16*** | (2006.01) |

(52) U.S. Cl.
CPC ..... *F04D 29/624* (2013.01); *D06F 58/02* (2013.01); *D06F 58/20* (2013.01); *F04D 17/16* (2013.01)

(58) Field of Classification Search
CPC .... F04D 29/602; F04D 29/603; F04D 29/606; F04D 29/607; F04D 29/626; F04D 29/624; F05B 2240/90
See application file for complete search history.

(56) References Cited

U.S. PATENT DOCUMENTS

| | | | | |
|---|---|---|---|---|
| 11,506,421 | B2 | 11/2022 | Funabiki et al. | |
| 11,592,881 | B2 * | 2/2023 | Yang | F28F 9/26 |
| 2024/0183098 | A1 * | 6/2024 | Angelini | D06F 58/24 |
| 2024/0229337 | A1 * | 7/2024 | Boado Encinosa | D06F 58/22 |

FOREIGN PATENT DOCUMENTS

| | | | | |
|---|---|---|---|---|
| CN | 115404634 | A * | 11/2022 | D06F 58/26 |
| CN | 219059507 | U | 5/2023 | |
| CN | 221645371 | U | 9/2024 | |
| KR | 102100256 | B1 | 4/2020 | |

OTHER PUBLICATIONS

Machine translation of CN115404634 (Year: 2022).*

* cited by examiner

*Primary Examiner* — Brian O Peters
(74) *Attorney, Agent, or Firm* — Dority & Manning, P.A.

(57) ABSTRACT

A laundry appliance may include a tub positioned within a cabinet, a wash basket rotatably mounted within the tub, the wash basket defining a chamber for receipt of articles for washing and drying, a dispensing assembly positioned near a top of the cabinet, and a blower assembly coupled to the dispensing assembly. The blower assembly may include a base plate, a blower cover attached to the base plate, a locating pin extending from the base plate, at least one locating knob extending from the base plate, and a blower fan including an exhaust port and defining a plurality of mounting apertures, wherein each of the plurality of mounting apertures are configured to receive one of the locating pin or the at least one locating knob respectively therein to align the exhaust port with the blower cover.

16 Claims, 6 Drawing Sheets

BLOWER ASSEMBLY WITH LOCATING FEATURES FOR AN APPLIANCE

FIELD OF THE INVENTION

The present subject matter relates generally to appliances, and more specifically, to blower assemblies for appliances.

BACKGROUND OF THE INVENTION

Appliances, such as clothes dryers, combination washer/dryer units, dishwashers, or similar devices, often include a blower assembly for directing a flow of air or process fluid through the appliance. For example, in a clothes dryer or combination laundry appliance, a blower assembly may be used to circulate heated air through a drying chamber to remove moisture from articles located therein. In a dishwasher appliance, a blower assembly may assist in circulating heated air to facilitate drying of washed items during a drying cycle. Regardless of the appliance type, the blower assembly is generally positioned within a housing and is fluidly connected to one or more ducts, outlets, or other flow path components to ensure proper air circulation.

In many conventional appliances, the blower assembly is secured within the appliance using multiple mounting points, fasteners, or brackets. The alignment of the blower housing relative to adjacent components is often performed manually during assembly, requiring careful positioning to ensure proper sealing, air flow performance, and mechanical stability. However, manual positioning is susceptible to alignment errors, resulting in air leaks, unwanted vibration, or interference with nearby components. Furthermore, improper alignment during installation can result in increased wear, noise generation, and reduced system efficiency over the life of the appliance.

Notably, conventional blower assemblies may lack dedicated locating features that guide the blower housing into a correct position relative to the appliance structure or mating ductwork. Instead, assembly personnel may rely on visual cues or loose tolerances in fastener holes to position the blower assembly. This process can increase assembly time, require additional rework, or necessitate the use of supplemental fixtures. Moreover, variations in manufacturing tolerances between components can exacerbate alignment issues, leading to reduced product quality and inconsistent performance across production units.

Accordingly, a blower assembly for an appliance that obviates one or more of the above-mentioned drawbacks would be beneficial. In particular, a blower assembly for an appliance that improves installation accuracy, reduces assembly time, and enhances long-term reliability and performance would be advantageous.

BRIEF DESCRIPTION OF THE INVENTION

Advantages of the invention will be set forth in part in the following description, or may be apparent from the description, or may be learned through practice of the invention.

In one exemplary embodiment, a blower assembly for an appliance is provided. The appliance defines a mutually orthogonal vertical direction, lateral direction, and transverse direction. The blower assembly may include a base plate, a blower cover attached to the base plate, a locating pin extending from the base plate, at least one locating knob extending from the base plate, and a blower fan including an exhaust port and defining a plurality of mounting apertures, wherein each of the plurality of mounting apertures are configured to receive one of the locating pin or the at least one locating knob respectively therein to align the exhaust port with the blower cover.

In another exemplary embodiment, a laundry appliance is provided. The laundry appliance defines a mutually orthogonal vertical direction, lateral direction, and transverse direction. The laundry appliance may include a tub positioned within a cabinet, a wash basket rotatably mounted within the tub, the wash basket defining a chamber for receipt of articles for washing and drying, a dispensing assembly positioned near a top of the cabinet, and a blower assembly coupled to the dispensing assembly. The blower assembly may include a base plate, a blower cover attached to the base plate, a locating pin extending from the base plate, at least one locating knob extending from the base plate, and a blower fan including an exhaust port and defining a plurality of mounting apertures, wherein each of the plurality of mounting apertures are configured to receive one of the locating pin or the at least one locating knob respectively therein to align the exhaust port with the blower cover.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
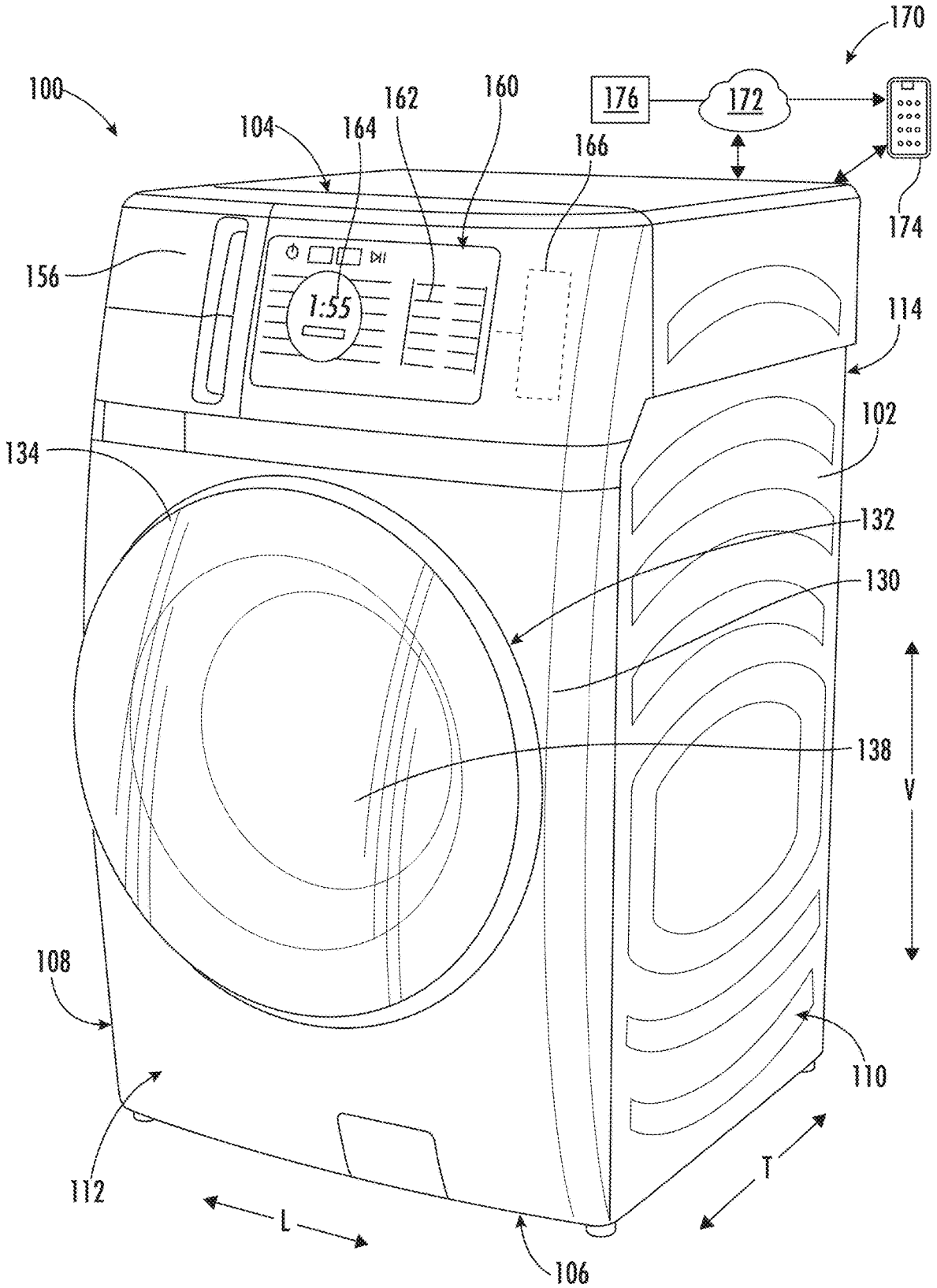
FIG. 1 provides a perspective view of a combination washer/dryer laundry appliance in accordance with exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and may not be intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). The term "at least one of" in the context of, e.g., "at least one of A, B, and C" refers to only A, only B, only C, or any combination of A, B, and C. As used herein, the terms "coupled," "fixed," "attached to," and the like refer to both direct coupling, fixing, or attaching, as well as indirect coupling, fixing, or attaching through one or more intermediate components or features, unless otherwise specified herein. In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As explained herein, aspects of the present subject matter are generally directed to a blower assembly for an appliance. Particularly, a blower assembly including locating features on a base plate for the blower fan is provided. The blower assembly may be configured to be positioned at the rear of a dispensing assembly for a combination washer and condenser dryer laundry appliance. The locating features on the base plate allow for a tool-free installation with tight tolerances. This blower assembly thus increases craftsmanship, improves assembly time, and reduces the component count for the appliance.

Figure 2:
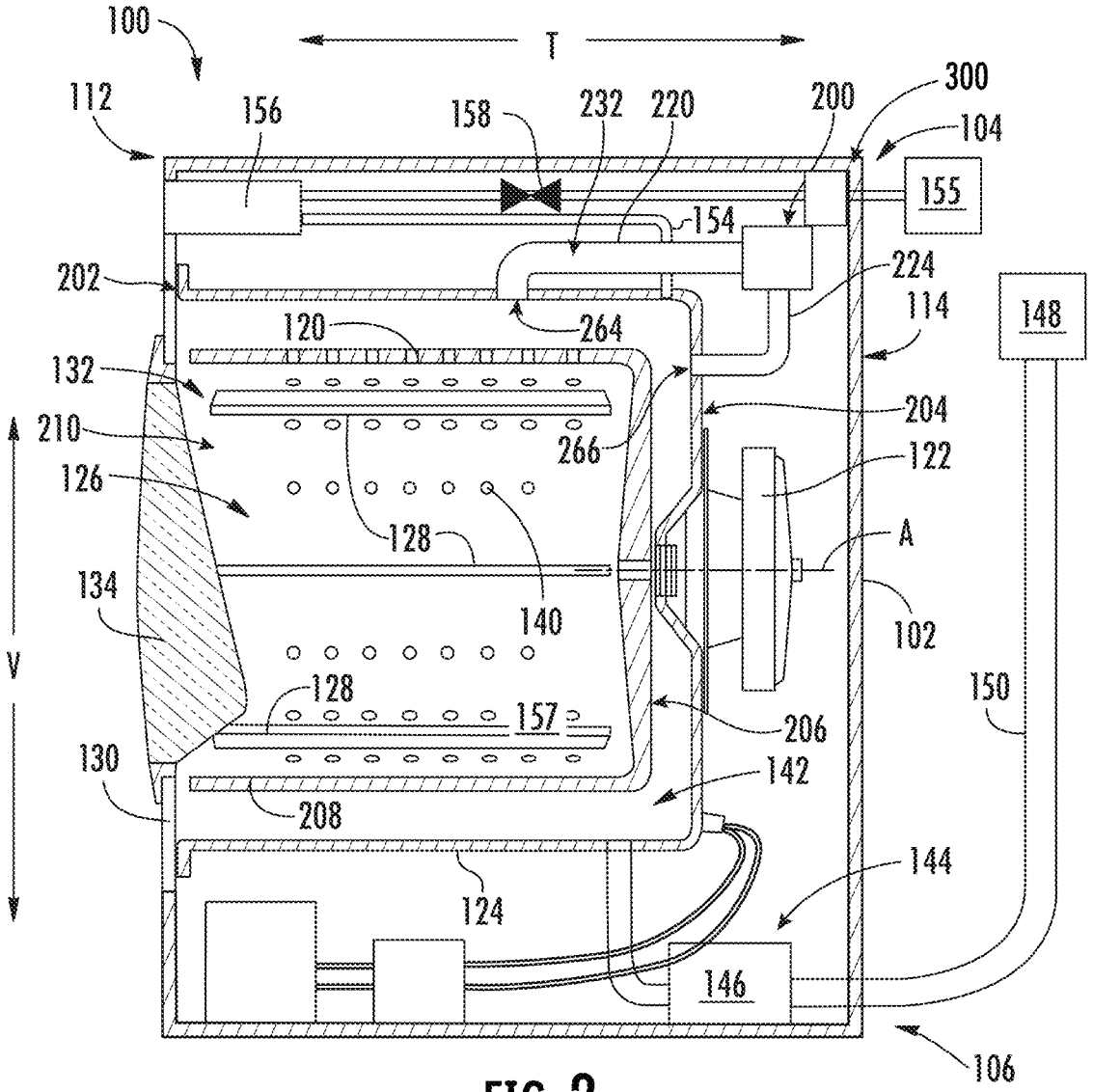
FIG. 2 provides a side cross-sectional view of the exemplary laundry appliance of FIG. 1 in accordance with exemplary embodiments of the present disclosure.
Figure 4:
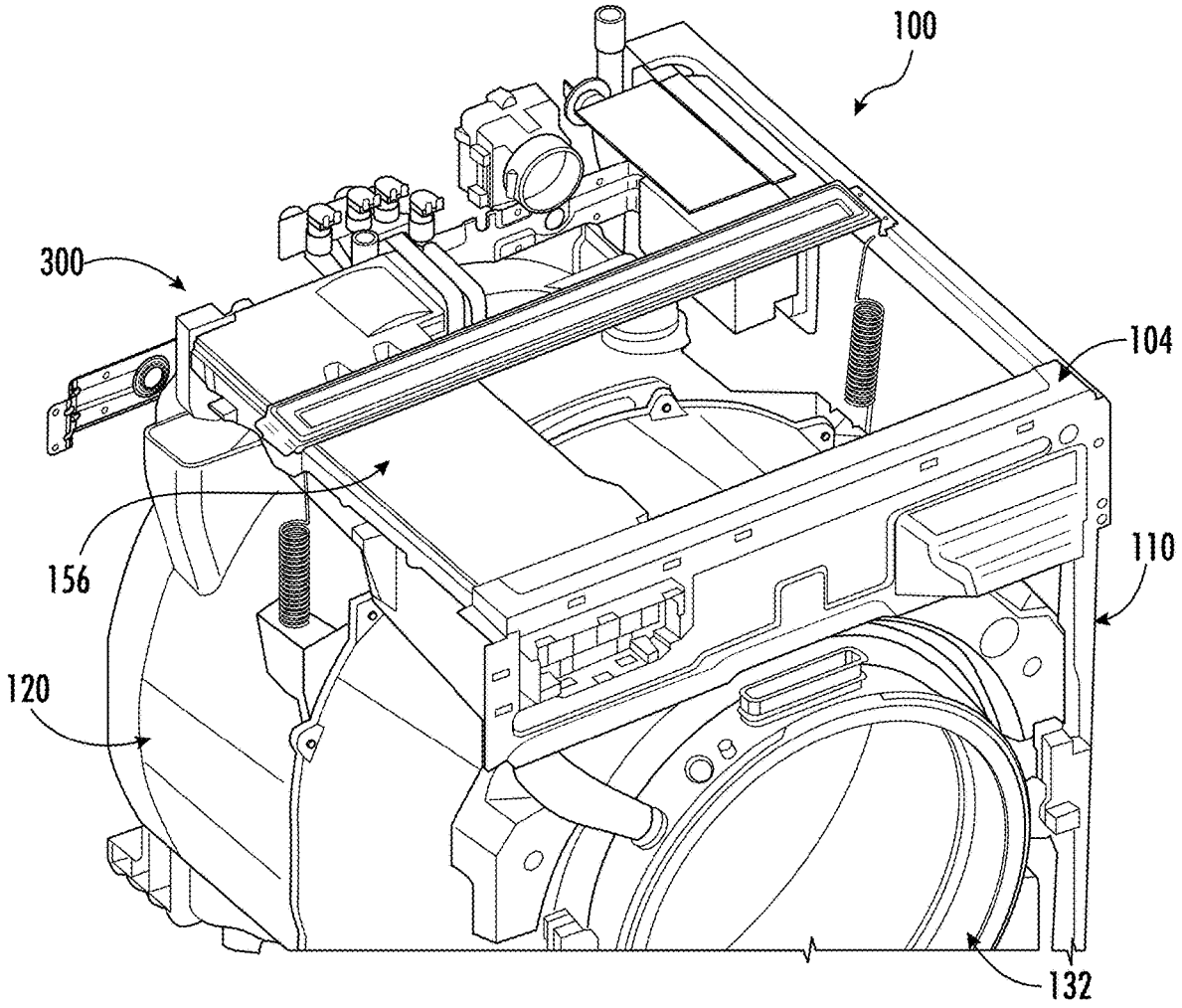
FIG. 4 provides a perspective view of the example laundry appliance of FIG. 1 with a cabinet and other parts of the laundry appliance removed to reveal certain components of the dryer appliance.

Referring now to the figures, an exemplary laundry appliance that may be used to implement aspects of the present subject matter will be described. Specifically, FIG. 1 is a perspective view of an exemplary horizontal axis washer and condenser dryer combination appliance 100, referred to herein for simplicity as laundry appliance 100. FIG. 2 is a side cross-sectional view of laundry appliance 100. FIG. 4 is a perspective view of laundry appliance 100 with cabinet 102 removed. As illustrated, laundry appliance 100 generally defines a vertical direction V, a lateral direction L, and a transverse direction T, each of which is mutually perpendicular, such that an orthogonal coordinate system is generally defined. Laundry appliance 100 includes a cabinet 102 that extends between a top 104 and a bottom 106 along the vertical direction V, between a left side 108 and a right side 110 along the lateral direction, and between a front 112 and a rear 114 along the transverse direction T.

Referring to FIG. 2, a laundry basket 120 is rotatably mounted within cabinet 102 such that it is rotatable about an axis of rotation A. According to the illustrated embodiment, axis of rotation A is substantially parallel to or slightly inclined relative to the horizontal direction (e.g., the transverse direction T), as this exemplary appliance is a front load appliance. A motor 122, e.g., such as a pancake motor, is in mechanical communication with laundry basket 120 to selectively rotate laundry basket 120 (e.g., during an agitation or a rinse cycle of laundry appliance 100). Motor 122 may be mechanically coupled to laundry basket 120 directly or indirectly, e.g., via a pulley and a belt (not pictured). Laundry basket 120 is received within a tub 124 that defines a chamber 126 that is configured for receipt of articles for washing or drying.

As used herein, the terms "clothing" or "articles" includes but need not be limited to fabrics, textiles, garments, linens, papers, or other items from which the extraction of moisture is desirable. Furthermore, the term "load" or "laundry load" refers to the combination of clothing that may be washed together and/or dried together in laundry appliance 100 (e.g., the combination washer and condenser dryer) and may include a mixture of different or similar articles of clothing of different or similar types and kinds of fabrics, textiles, garments and linens within a particular laundering process.

The tub 124 holds wash and rinse fluids for agitation in laundry basket 120 within tub 124. As used herein, "wash fluid" may refer to water, detergent, fabric softener, bleach, or any other suitable wash additive or combination thereof. Indeed, for simplicity of discussion, these terms may all be used interchangeably herein without limiting the present subject matter to any particular "wash fluid."

Laundry basket 120 may define one or more agitator features that extend into chamber 126 to assist in agitation, cleaning, and drying of articles disposed within chamber 126 during operation of laundry appliance 100. For example, as illustrated in FIG. 2, a plurality of baffles or ribs 128 extend from basket 120 into chamber 126. In this manner, for example, ribs 128 may lift articles disposed in laundry basket 120 and then allow such articles to tumble back to a bottom of drum laundry basket 120 as it rotates. Ribs 128 may be mounted to laundry basket 120 such that ribs 128 rotate with laundry basket 120 during operation of laundry appliance 100.

Referring generally to FIGS. 1 and 2, cabinet 102 also includes a front panel 130 which defines an opening 132 that permits user access to laundry basket 120 and tub 124. More specifically, laundry appliance 100 includes a door assembly 134 that is positioned over opening 132 and is rotatably mounted to front panel 130. In this manner, door assembly 134 permits selective access to opening 132 by being movable between an open position (not shown) facilitating access to a tub 124 and a closed position (FIG. 1) prohibiting access to tub 124. Laundry appliance 100 may further include a latch assembly that is mounted to cabinet 102 and/or door assembly 134 for selectively locking door assembly 134 in the closed position. The latch assembly may be desirable, for example, to ensure only secured access to chamber 126 or to otherwise ensure and verify that door assembly 134 is closed during certain operating cycles or events.

A window 138 in door assembly 134 permits viewing of laundry basket 120 when door assembly 134 is in the closed position, e.g., during operation of laundry appliance 100. Door assembly 134 also includes a handle (not shown) that, e.g., a user may pull when opening and closing door assembly 134. Further, although door assembly 134 is illustrated as mounted to front panel 130, it should be appreciated that door assembly 134 may be mounted to another side of cabinet 102 or any other suitable support according to alternative embodiments.

Referring again to FIG. 2, laundry basket 120 also defines a plurality of perforations 140 in order to facilitate fluid communication between an interior of basket 120 and tub 124. A sump 142 is defined by tub 124 at a bottom of tub 124 along the vertical direction V. Thus, sump 142 is configured for receipt of and generally collects wash fluid during operation of laundry appliance 100. For example, during operation of laundry appliance 100, wash fluid may be urged by gravity from basket 120 to sump 142 through plurality of perforations 140.

A drain pump assembly 144 is located beneath tub 124 and is in fluid communication with sump 142 for periodically discharging soiled wash fluid from laundry appliance 100. Drain pump assembly 144 may generally include a drain pump 146 which is in fluid communication with sump 142 and with an external drain 148 through a drain hose 150. During a drain cycle, drain pump 146 urges a flow of wash fluid from sump 142, through drain hose 150, and to external drain 148. More specifically, drain pump 146 includes a motor (not shown) which is energized during a drain cycle such that drain pump 146 draws wash fluid from sump 142 and urges it through drain hose 150 to external drain 148.

A spout 154 is configured for directing a flow of fluid into tub 124. For example, spout 154 may be in fluid communication with a water supply 155 (FIG. 2) in order to direct fluid (e.g., clean water or wash fluid) into tub 124. Spout 154 may also be in fluid communication with the sump 142. For example, pump assembly 144 may direct wash fluid disposed in sump 142 to spout 154 in order to circulate wash fluid in tub 124.

As illustrated in FIG. 2, a dispenser assembly may be included in the laundry appliance 100, which may include a detergent drawer 156 slidably mounted within front panel 130. Detergent drawer 156 receives a wash additive (e.g., detergent, fabric softener, bleach, or any other suitable liquid or powder) and directs the fluid additive to wash chamber 126 during operation of laundry appliance 100. According to the illustrated embodiment, detergent drawer 156 may also be fluidly coupled to spout 154 to facilitate the complete and accurate dispensing of wash additive.

In optional embodiments, a bulk reservoir 157 is disposed within cabinet 102 and is configured for receipt of fluid additive or detergent for use during operation of laundry appliance 100. Moreover, bulk reservoir 157 may be sized such that a volume of fluid additive sufficient for a plurality or multitude of wash cycles of laundry appliance 100 (e.g., five, ten, twenty, fifty, or any other suitable number of wash cycles) may fill bulk reservoir 157. Thus, for example, a user can fill bulk reservoir 157 with fluid additive and operate laundry appliance 100 for a plurality of wash cycles without refilling bulk reservoir 157 with fluid additive. A reservoir pump (not shown) may be configured for selective delivery of the fluid additive from bulk reservoir 157 to tub 124.

In addition, a water supply valve or control valve 158 may provide a flow of water from a water supply source (such as a municipal water supply 155) into detergent dispenser 156 and/or into tub 124. In this manner, control valve 158 may generally be operable to supply water into detergent dispenser 156 to generate a wash fluid, e.g., for use in a wash cycle, or a flow of fresh water, e.g., for a rinse cycle. It should be appreciated that control valve 158 may be positioned at any other suitable location within cabinet 102. In addition, although control valve 158 is described herein as regulating the flow of "wash fluid," it should be appreciated that this term includes, water, detergent, other additives, or some mixture thereof.

A control panel 160 including a plurality of input selectors 162 is coupled to front panel 130. Control panel 160 and input selectors 162 collectively form a user interface input for operator selection of machine cycles and features. For example, in one embodiment, a display 164 indicates selected features, a countdown timer, and/or other items of interest to machine users.

Operation of laundry appliance 100 is controlled by a controller or processing device 166 (FIG. 1) that is operatively coupled to control panel 160 for user manipulation to select laundry cycles and features. In response to user manipulation of control panel 160, controller 166 operates the various components of laundry appliance 100 to execute selected machine cycles and features.

Controller 166 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 166 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 160 and other components of laundry appliance 100 may be in communication with controller 166 via one or more signal lines or shared communication busses.

During operation of laundry appliance 100, laundry items are loaded into laundry basket 120 through opening 132, and washing operation is initiated through operator manipulation of input selectors 162. Tub 124 is filled with water, detergent, and/or other fluid additives, e.g., via spout 154 and or detergent drawer 156. One or more valves (e.g., control valve 158) can be controlled by laundry appliance 100 to provide for filling laundry basket 120 to the appropriate level for the amount of articles being washed and/or rinsed. By way of example for a wash mode, once laundry basket 120 is properly filled with fluid, the contents of laundry basket 120 can be agitated (e.g., with ribs 128) for washing of laundry items in laundry basket 120.

After the agitation phase of the wash cycle is completed, tub 124 can be drained. Laundry articles can then be rinsed by again adding fluid to tub 124, depending on the particulars of the cleaning cycle selected by a user. Ribs 128 may again provide agitation within laundry basket 120. One or more spin cycles may also be used. In particular, a spin cycle may be applied after the wash cycle and/or after the rinse cycle in order to wring wash fluid from the articles being washed. During a final spin cycle, basket 120 is rotated at relatively high speeds and drain pump assembly 144 may discharge wash fluid from sump 142. After articles disposed in laundry basket 120 are cleaned, washed, and/or rinsed, the user can remove the articles from laundry basket 120, e.g., by opening door assembly 134 and reaching into laundry basket 120 through opening 132.

While described in the context of a specific embodiment of horizontal axis laundry appliance 100, using the teachings disclosed herein it will be understood that horizontal axis laundry appliance 100 is provided by way of example only. Other laundry appliances having different configurations, different appearances, and/or different features may also be utilized with the present subject matter as well, e.g., vertical axis laundry appliances. Indeed, it should be appreciated that aspects of the present subject matter may further apply to other laundry appliances.

Referring still to FIG. 1, a schematic diagram of an external communication system 170 will be described according to an exemplary embodiment of the present subject matter. In general, external communication system 170 is configured for permitting interaction, data transfer, and other communications with laundry appliance 100. For example, this communication may be used to provide and receive operating parameters, user instructions or notifications, performance characteristics, user preferences, or any other suitable information for improved performance of laundry appliance 100.

External communication system 170 permits controller 166 of laundry appliance 100 to communicate with external devices either directly or through a network 172. For example, a consumer may use a consumer device 174 to communicate directly with laundry appliance 100. For example, consumer devices 174 may be in direct or indirect communication with laundry appliance 100, e.g., directly through a local area network (LAN), Wi-Fi, Bluetooth, Zigbee, etc. or indirectly through network 172. In general, consumer device 174 may be any suitable device for providing and/or receiving communications or commands from a user. In this regard, consumer device 174 may include, for example, a personal phone, a tablet, a laptop computer, or another mobile device.

In addition, a remote server 176 may be in communication with laundry appliance 100 and/or consumer device 174 through network 172. In this regard, for example, remote server 176 may be a cloud-based server 176, and is thus located at a distant location, such as in a separate state, country, etc. In general, communication between the remote server 176 and the client devices may be carried via a network interface using any type of wireless connection, using a variety of communication protocols (e.g. TCP/IP, HTTP, SMTP, FTP), encodings or formats (e.g. HTML, XML), and/or protection schemes (e.g. VPN, secure HTTP, SSL).

In general, network 172 can be any type of communication network. For example, network 172 can include one or more of a wireless network, a wired network, a personal area network, a local area network, a wide area network, the internet, a cellular network, etc. According to an exemplary embodiment, consumer device 174 may communicate with a remote server 176 over network 172, such as the internet, to provide user inputs, receive user notifications or instructions, etc. In addition, consumer device 174 and remote server 176 may communicate with laundry appliance 100 to communicate similar information.

External communication system 170 is described herein according to an exemplary embodiment of the present subject matter. However, it should be appreciated that the exemplary functions and configurations of external communication system 170 provided herein are used only as examples to facilitate description of aspects of the present subject matter. System configurations may vary, other communication devices may be used to communicate directly or indirectly with one or more laundry appliances, other communication protocols and steps may be implemented, etc. These variations and modifications are contemplated as within the scope of the present subject matter.

Figure 3:
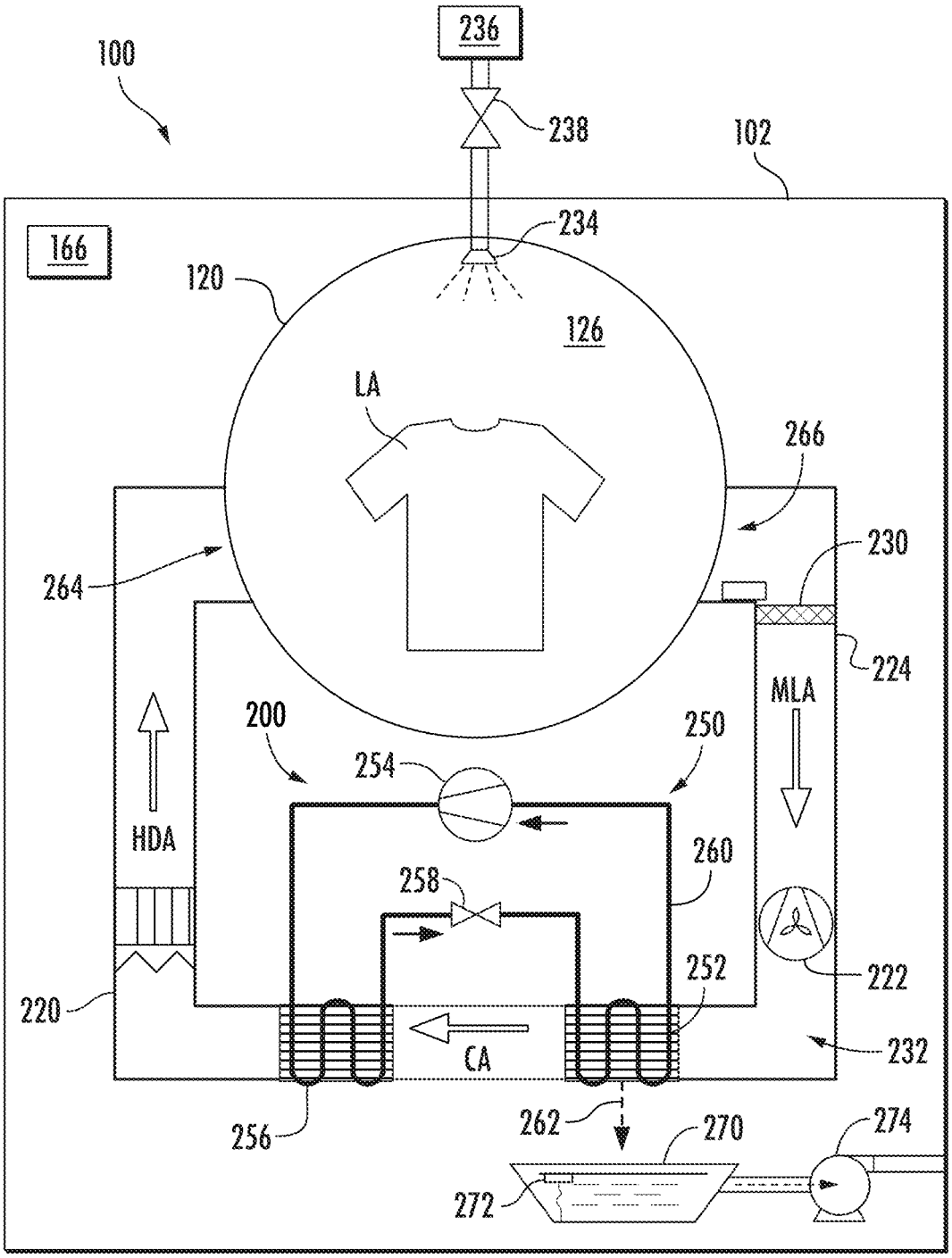
FIG. 3 provides a schematic diagram of an exemplary heat pump dryer appliance and a conditioning system thereof in accordance with exemplary embodiments of the present disclosure.

Referring now specifically to FIGS. 2 through 3, a heat pump system, a condenser system, a refrigerant-based air conditioning system, or another suitable conditioning system 200 for facilitating a drying process within laundry appliance 100 will be described in more detail. As illustrated, conditioning system 200 may be mounted to tub 124 such that it is fluidly coupled to chamber 126. More specifically, as illustrated, tub 124 extends between a front portion 202 and a back portion 204, e.g., along the transverse direction T. Laundry basket 120 also includes a back or rear wall 206, e.g., at back portion of laundry basket 120 or proximate back portion 204 of tub 124. Rear wall 206 of laundry basket 120 may be rotatably supported within cabinet 102 by a suitable bearing and/or may be fixed or rotatable.

Laundry basket 120 is generally cylindrical in shape. Laundry basket 120 has an outer cylindrical wall 208 and a front flange or wall that defines an opening 210 of laundry basket 120, e.g., at front portion 202 of laundry basket 120. As shown, opening 210 generally coincides with opening 132 of front panel 112 of cabinet 102, e.g., to provide user access to chamber 126 for loading and unloading of articles into and out of chamber 126 of laundry basket 120.

Conditioning system 200 may generally include a supply duct 220 that is mounted to tub 124 for circulating air within chamber 126 to facilitate a drying process. For example, according to the illustrated exemplary embodiment, supply duct 220 is fluidly coupled to tub 124 proximate opening 132 of front panel 130. More specifically, according to an example embodiment, supply duct 220 passes through a door gasket (not shown) that is mounted to tub 124 at opening 132 and is configured for forming a seal with door assembly 134 when door assembly 134 is in a closed position. Supply duct 220 receives heated air that has been heated and/or dehumidified by a conditioning system 200 and provides the heated air to laundry basket 120 via supply duct 220.

Specifically, moisture laden, heated air is drawn from laundry basket 120 by an air handler, such as a main blower fan 224, which generates a negative air pressure within laundry basket 120. As the air passes from main blower fan 224, it is circulated through chamber 126, enters a return duct 226, and then is passed into conditioning system 200. In some embodiments, the conditioning system 200 may be or include an electric heating element, e.g., a resistive heating element, or a gas-powered heating element, e.g., a gas burner. According to the illustrated exemplary embodiment, laundry appliance 100 is a heat pump dryer appliance and thus conditioning system 200 may be or include a heat pump including a sealed refrigerant circuit, as described in more detail below with reference to FIG. 3. Heated air (with a lower moisture content than was received from laundry basket 120), exits conditioning system 200 and returns to laundry basket 120 by a supply duct 220. After the clothing articles have been dried, they are removed from the laundry basket 120 via opening 132.

As shown, laundry appliance 100 may further include one or more lint filters 230 (FIG. 3) to collect lint during drying operations. The moisture laden heated air passes through return duct 226 enclosing screen filter 230, which traps lint particles. More specifically, filter 230 may be placed into an air flow path 232 defined by laundry basket 120, conditioning system 200, return duct 226, and supply duct 220. Filter 230 may be positioned in the process air flow path 232 and may include a screen, mesh, or other material to capture lint in the air flow 232. The location of lint filters in laundry appliance 100 as shown in FIG. 3 is provided by way of example only, and other locations may be used as well. According to exemplary embodiments, lint filter 230 is readily accessible by a user of the appliance. As such, lint filter 230 should be manually cleaned by removal of the filter, pulling or wiping away accumulated lint, and then replacing the filter 230 for subsequent drying cycles.

According to exemplary embodiments, laundry appliance 100 may facilitate a steam dry process. In this regard, laundry appliance 100 may offer a steam drying cycle, during which steam is injected into chamber 126, e.g., to function similar to a traditional garment steamer to help remove wrinkles, static, etc. Accordingly, as shown for example in FIG. 3, laundry appliance 100 may include a misting nozzle 234 that is in fluid communication with a water supply 236 (e.g., such as water supply 155) in order to direct mist into chamber 126. Laundry appliance 100 may further include a water supply valve or control valve 238 for selecting discharging the flow of mist into chamber 126. It should be appreciated that control valve 238 may be positioned at any other suitable location within cabinet 102.

FIG. 3 provides a schematic view of laundry appliance 100 and depicts conditioning system 200 in more detail. For this embodiment, laundry appliance 100 is a heat pump dryer appliance and thus conditioning system 200 includes a sealed system 250. Sealed system 250 includes various operational components, which can be encased or located within a machinery compartment of laundry appliance 100. Generally, the operational components are operable to execute a vapor compression cycle for heating process air passing through conditioning system 200. The operational components of scaled system 250 include an evaporator 252, a compressor 254, a condenser 256, and one or more expansion devices 258 connected in series along a refrigerant circuit or line 260. Refrigerant line 260 is charged with a working fluid, which in this example is a refrigerant. Sealed system 250 depicted in FIG. 3 is provided by way of example only. Thus, it is within the scope of the present subject matter for other configurations of the sealed system to be used as well. As will be understood by those skilled in the art, sealed system 250 may include additional components, e.g., at least one additional evaporator, compressor, expansion device, and/or condenser. As an example, sealed system 250 may include two (2) evaporators.

In performing a drying and/or tumbling cycle, one or more laundry articles LA may be placed within the chamber 126 of laundry basket 120. Hot dry air HDA is supplied to chamber 126 via supply duct 220. The hot dry air HDA enters chamber 126 of laundry basket 120 via a supply opening 264 defined by laundry basket 120, e.g., the plurality of holes defined in rear wall 206 and/or cylindrical wall 208 of laundry basket 120 as shown in FIG. 2. The hot dry air HDA provided to chamber 126 causes moisture within laundry articles LA to evaporate. Accordingly, the air within chamber 126 increases in water content and exits chamber 126 as warm moisture laden air MLA. The warm moisture laden air MLA exits chamber 126 through a return opening 266 defined by laundry basket 120 and flows into return duct 226.

After exiting chamber 126 of laundry basket 120, the warm moisture laden air MLA flows downstream to conditioning system 200. Main blower fan 224 moves the warm moisture laden air MLA, as well as the air more generally, through a process air flow path 232 defined by laundry basket 120, conditioning system 200, return duct 226, and supply duct 220. Thus, generally, main blower fan 224 is operable to move air through or along the process air flow path 232. The duct system includes all ducts that provide fluid communication (e.g., airflow communication) between return opening 266 and conditioning system 200 and between conditioning system 200 and supply opening 264. Although main blower fan 224 is shown positioned between laundry basket 120 and conditioning system 200 along return duct 226, it will be appreciated that main blower fan 224 can be positioned in other suitable positions or locations along the duct system. Further, it is contemplated that an additional blower fan or blower fans, e.g., blower fan 310, may be included in laundry appliance 100 as well, as will be discussed in more detail below.

As further depicted in FIG. 3, the warm moisture-laden air MLA flows into or across evaporator 252 of the conditioning system 200. As the moisture-laden air MLA passes across evaporator 252, the temperature of the air is reduced through heat exchange with refrigerant that is vaporized within, for example, coils or tubing of evaporator 252. This vaporization process absorbs both the sensible and the latent heat from the moisture-laden air MLA-thereby reducing its temperature. As a result, moisture in the air is condensed and such condensate water may be drained from conditioning system 200, e.g., using a drain line 262, which is also depicted in FIG. 3.

For this embodiment, a condenser tank or a condensate collection tank 270 is in fluid communication with conditioning system 200, e.g., via drain line 262. Collection tank 270 is operable to receive condensate water from the process air flowing through conditioning system 200, and more particularly, condensate water from evaporator 252. A sensor 272 is operable to detect when water within collection tank 270 has reached a predetermined level. Sensor 272 can be any suitable type of sensor, such as a float switch as shown in FIG. 3. Sensor 272 can be communicatively coupled with controller 166, e.g., via a suitable wired or wireless communication link. A drain pump 274 is in fluid communication with collection tank 270. Drain pump 274 is operable to remove a volume of water from collection tank 270 and, for example, discharge the collected condensate to an external drain. In some embodiments, drain pump 274 can remove a known or predetermined volume of water from collection tank 270. Drain pump 274 can remove the condensate water from collection tank 270 and can move or drain the condensate water downstream, e.g., to a gray water collection system. Particularly, in some embodiments, controller 166 is configured to receive, from sensor 272, an input indicating that water within the collection tank has reached the predetermined level. In response to the input indicating that water within collection tank 270 has reached the predetermined level, controller 166 can cause drain pump 274 to remove the predetermined volume of water from collection tank 270.

Air passing over evaporator 252 becomes cooler than when it exited laundry basket 120 at return opening 266. As shown in FIG. 3, cool air CA (cool relative to hot dry air HDA and moisture laden air MLA) flowing downstream of evaporator 252 is subsequently caused to flow across condenser 256, e.g., across coils or tubing thereof, which condenses refrigerant therein. The refrigerant enters condenser 256 in a gaseous state at a relatively high temperature compared to the cool air CA from evaporator 252. As a result, heat energy is transferred to the cool air CA at the condenser 256, thereby elevating its temperature and providing warm dry air HDA for resupply to laundry basket 120 of laundry appliance 100. The warm dry air HDA passes over and around laundry articles LA within the chamber 126 of the laundry basket 120, such that warm moisture laden air MLA is generated, as mentioned above. Because the air is recycled through laundry basket 120 and conditioning system 200, laundry appliance 100 can have a much greater efficiency than traditional clothes dryers can where all of the warm, moisture-laden air MLA is exhausted to the environment.

With respect to sealed system 250, compressor 254 pressurizes refrigerant (i.e., increases the pressure of the refrigerant) passing therethrough and generally motivates refrigerant through the sealed refrigerant circuit or refrigerant line 260 of conditioning system 200. Compressor 254 may be communicatively coupled with controller 166 (communication lines not shown in FIG. 3). Refrigerant is supplied from the evaporator 252 to compressor 254 in a low-pressure gas phase. The pressurization of the refrigerant within compressor 254 increases the temperature of the refrigerant. The compressed refrigerant is fed from compressor 254 to condenser 256 through refrigerant line 260. As the relatively cool air CA from evaporator 252 flows across condenser 256, the refrigerant is cooled and its temperature is lowered as heat is transferred to the air for supply to chamber 126 of laundry basket 120.

Upon exiting condenser 256, the refrigerant is fed through refrigerant line 260 to expansion device 258. Although only one expansion device 258 is shown, such is by way of example only. It is understood that multiple such devices may be used. In the illustrated example, expansion device 258 is an electronic expansion valve, although a thermal expansion valve or any other suitable expansion device can be used. In additional embodiments, any other suitable expansion device, such as a capillary tube, may be used as well. Expansion device 258 lowers the pressure of the refrigerant and controls the amount of refrigerant that is allowed to enter the evaporator 252. Importantly, the flow of liquid refrigerant into evaporator 252 is limited by expansion device 258 in order to keep the pressure low and allow expansion of the refrigerant back into the gas phase in evaporator 252. The evaporation of the refrigerant in evaporator 252 converts the refrigerant from its liquid-dominated phase to a gas phase while cooling and drying the moisture laden air MLA received from chamber 126 of laundry basket 120. The process is repeated as air is circulated along process air flow path 232 while the refrigerant is cycled through sealed system 250, as described above.

Although laundry appliance 100 is depicted and described herein as a heat pump dryer appliance, the inventive aspects of the present disclosure can apply to other types of closed loop airflow circuit dryer appliances. For instance, in other embodiments, laundry appliance 100 can be a condenser dryer that utilizes an air-to-air heat exchanger instead of evaporator 252 and/or an electric heater may be provided instead of condenser 256. Thus, in such embodiments, the working fluid that interacts thermally with the process air may be air. In yet other embodiments, laundry appliance 100 can be a spray tower dryer appliance that utilizes a water-to-air heat exchanger instead of utilizing a sealed refrigerant. Thus, in such embodiments, the working fluid that interacts thermally with the process air may be water. Further, in some embodiments, laundry appliance 100 can be a combination washer/dryer appliance having a closed loop airflow circuit along which process air may flow for drying operations.

In a similar regard, although the present disclosure is directed to a laundry appliance, this is for illustrative purposes only and is not intended to be limiting in any way. The blower assembly, as will be discussed in greater detail below, may be deployed in any appliance that utilizes a blower fan. For example, this may include a dishwashing appliance, a dryer appliance, a refrigerator appliance, etc. Aspects of the present disclosure relating to the blower assembly's use in other appliances will be appreciated by one of skill in the art, and embodiments of the blower assembly used in other appliances are contemplated within the scope of the present disclosure.

Now referring to FIGS. 4 through 8, example embodiments of a blower assembly 300 and its integration into an appliance, e.g., laundry appliance 100, will be described in detail. As previously mentioned, the appliance, e.g., laundry appliance 100, defines a mutually orthogonal vertical direction V, lateral direction L, and transverse direction T. As shown in FIG. 4, blower assembly 300 is positioned proximate to a dispensing assembly 156 and is configured to function during certain operating events. In some example embodiments, blower assembly 300 functions as an auxiliary air mover that operates independently of main blower fan 224 to deliver a concentrated flow to dispensing assembly 156 without diverting or repurposing airflow along process air flow path 232. By locating blower assembly 300 at or near dispensing assembly 156, moisture management, additive drying, and/or odor mitigation may be improved while reducing the need for long ducts, elbows, or additional seals.

Figure 6:
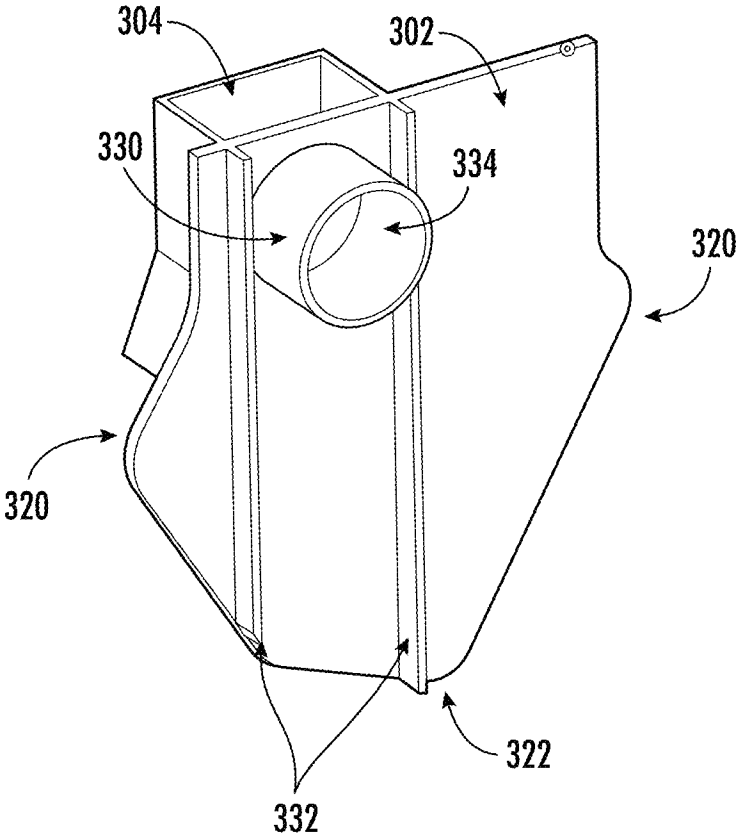
FIG. 6 provides a rear perspective view of the exemplary base plate for the exemplary blower assembly of FIG. 5 in accordance with exemplary embodiments of the present disclosure.
Figure 8:
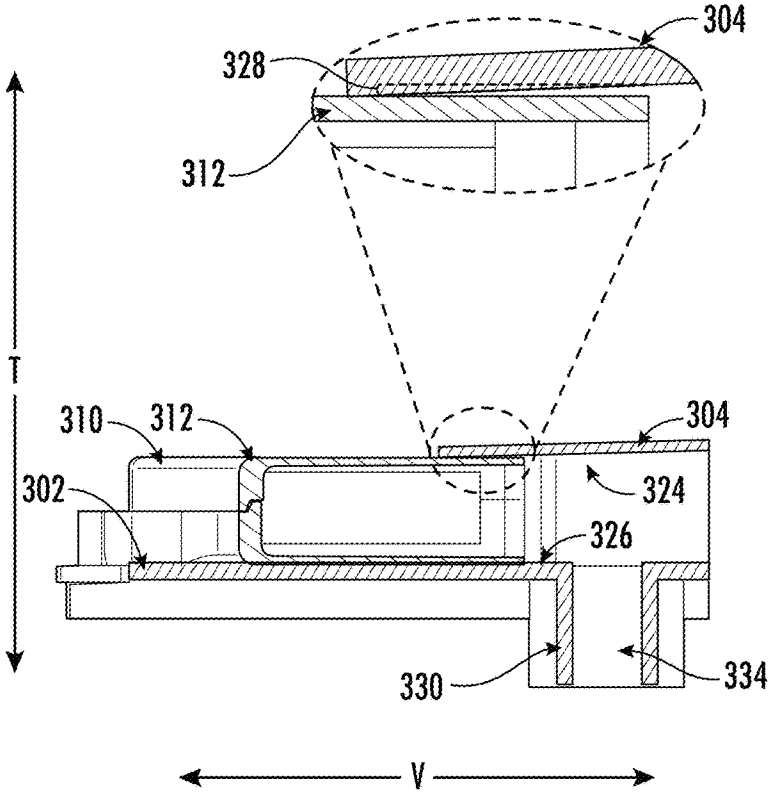
FIG. 8 provides a side cross-sectional view of the exemplary blower assembly of FIG. 7 in accordance with exemplary embodiments of the present disclosure.
Figure 7:
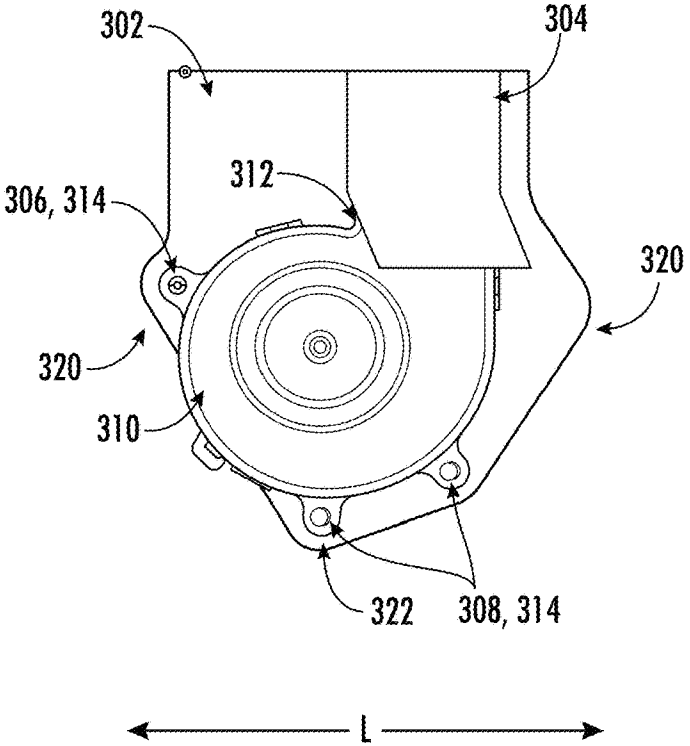
FIG. 7 provides a perspective view of an exemplary blower assembly in accordance with exemplary embodiments of the present disclosure.

As best illustrated in FIGS. 5 through 8, aspects of an example blower assembly 300 are provided. Generally, blower assembly 300 may include a base plate 302, a blower cover 304 attached to the base plate, a locating pin extending from the base plate 302, at least one locating knob 308 extending from the base plate 302, and a blower fan 310 comprising an exhaust port 312. The blower fan 310 may define a plurality of mounting apertures 314 that are each configured to receive one of the locating pin 306 or the locating knob 308, which provides proper alignment for the exhaust port 312 within the blower cover 304 (FIGS. 7 and 8). The airflow generated by blower fan 310 exits through the exhaust port 312 and is guided by blower cover 304 toward dispensing assembly 156, often through an attachment component 330.

Figure 5:
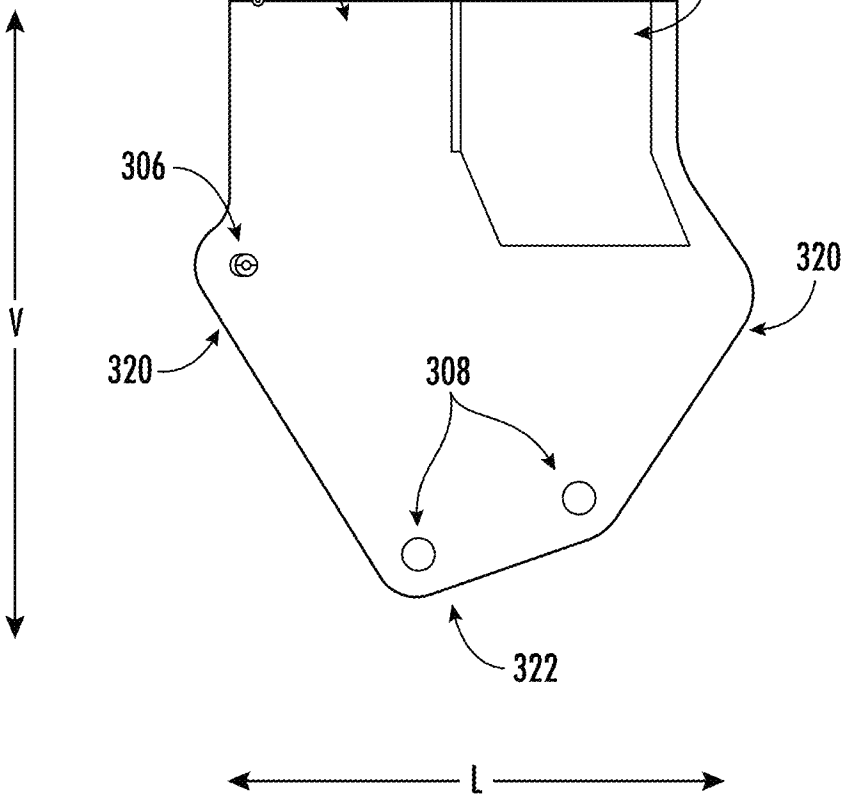
FIG. 5 provides a front perspective view of an exemplary base plate for an exemplary blower assembly in accordance with exemplary embodiments of the present disclosure.

Base plate 302 provides the primary structural support and orientation for the locating features. As illustrated in FIGS. 5 and 6, the blower cover 304 is fixed along or near one lateral edge 320 of base plate 302. Further, locating pin 306 is positioned adjacent to a lateral edge 320 of the base plate 302 opposite that of the blower cover 304. In this position, locating pin 306 prevents the movement of blower fan 310 in the vertical direction V and lateral direction L while serving as a pivot point for the blower fan 310 during installation. Locating pin 306 engages a corresponding one of the mounting apertures 314 in blower fan 310 to establish a defined fixed point for alignment and orientation. Further locating pin 306 serves to constrain motion in the vertical direction V and lateral direction L while allowing controlled rotation in the plane of the base plate 302 about the locating pin's 306 axis during assembly.

Also present on the base plate 302 is at least one locating knob 308. The locating knob 308, or as shown in FIGS. 5 and 7, a plurality of locating knobs 308 are positioned near a bottom edge 322 of the base plate 302. Although a plurality of locating knobs 308 are illustrated, example embodiments including only one locating knob 308 are considered within the scope of the present disclosure. Each of the at least one locating knob 308 extends partially into each respective mounting aperture 314 of the plurality of mounting apertures 314 when blower fan 310 is fully seated. During assembly, the at least one locating knob 308 is positioned within their respective mounting aperture 314 of the plurality of mounting apertures 314 by rotating blower fan 310 about the locating pin 306 from an initial position where the blower fan is only engaged with the locating pin 306 to a final, locked position where the remaining vacant mounting aperture(s) 314 have received the locating knob(s) 308 therein. By extending only partially into the mounting apertures 314, locating knobs 308 provide a lead-in effect that assists in pulling blower fan 310 tightly against base plate 302 and in aligning exhaust port 312 concentrically with blower cover 304, while also permitting small elastic accommodation of dimensional variation without binding. In this regard, the locating knob 308 provides tactile feedback during rotation of the blower fan 310, while allowing for the blower fan to continue its rotation over the locating knob 308, positioning the locating knob 308 within its respective aperture 314. Once the at least one knob(s) 308 are positioned within each respective plurality of mounting apertures 314, the at least one locating knob 308 provides physical resistance to the rotational movement of the blower fan 310 about the locating pin 306.

In some example embodiments, and as illustrated, the at least one locating knob 308 is generally semi-circle shaped (FIGS. 5 through 8). A generally semi-circle shaped knob presented a rounded lead-in edge facing the rotational path of blower fan 310, which facilitates a tool-free installation by encouraging self-centering of mounting apertures 314 as the blower fan is rotated about the locating pin 306. The semicircular profile also distributes contact forces over a larger arc to reduce an abrupt contact point and to provide a predictable interference range for rattle-free retention. Further, the shape improves tolerance robustness as compared to sharp-cornered alternatives. However, in alternative embodiments, the locating knob 308 may take varying shapes and such shapes are considered within the scope of the present disclosure. For example, the locating knob 308 may include spherical segments, truncated cones, ovals, cylindrical bosses with chamfered caps, and/or polygonal lobes, any of which may be sized to extend partially into the corresponding mounting apertures 314 to achieve the same partial-engagement alignment and anti-rattle functions. In some example embodiments, the one or more locating knob 308 may incorporate an elastically deflectable shell or a spring-biased insert to provide additional preload against blower fan 310.

Blower cover 304 cooperates with blower fan 310 to create a compact outlet plenum that conditions and directs the air stream. As illustrated in FIG. 8, an internal top plane 324 of the blower cover 304 defines a tapered angle 328. This angle is exaggerated for illustrative effect. Further, an internal bottom plane 326 of the blower cover 304 similarly defines a tapered angle (not shown). In some example embodiments, the tapered angle 328 of the internal top plane 324 is greater than the tapered angle (not shown) of internal bottom plane 326. The tapered angle 328 of the internal top plane 324 creates an interference with a top surface of the blower fan 310 with blower cover 304. This interference may provide a frictional and geometric seal that inhibits recirculation and leakage at high static pressure and damps vibration. Further, the interference may help lock blower fan 310 against base plate 302 in cooperation with locating pin 306 and the at least one locating knob 308. In some example embodiments, the tapered angle 328 additionally accommodates thermal growth by allowing the bottom plane 326 to act as a guidance surface while top plane 324 maintains the primary interference seal during operation.

Although illustrated as an interference-fit seal provided by the tapered angle 328, additional or alternative sealing approaches may be used and are considered within the scope of the present disclosure. For example, a compressible gasket disposed along one or both planes 324, 326 may be deployed. Other examples, additionally or alternatively, include an overmolded elastomeric lip on blower cover 304 contracting the fan shroud of the blower fan 310, a foam or felt strip to attenuate tonal noise, and/or an O-ring compressed between the blower cover 304 and the blower fan 310. In some example embodiments, a minimal interference may be used primarily for positional retention while a discrete gasket provides the primary air seal.

Blower assembly 300 may further include an attachment component 330 extending from a rear of the base plate 302 (rear being toward rear 114 of cabinet 102 along transverse direction T). Attachment component 330 is configured to be coupled to or located adjacent to the dispensing assembly 156 for the laundry appliance 100. As illustrated in FIG. 6, attachment component 330 includes one or more alignment extensions 332 that mate with corresponding slots, bosses, recesses, or apertures of the rear of dispensing assembly 156 or other intermediate component, to provide a repeatable datum in the lateral direction L, vertical direction V, and transverse direction T during installation. An opening 334 is defined within attachment component and is positioned to register with a mating opening of dispensing assembly 156, or other intermediate component, so that when exhaust port 312 is aligned with blower cover 304, air is communicated directly through opening 334 into a flow path within dispensing assembly 156. In some example embodiments, alignment extensions 332 provide snap-fit or interference-fit retention into dispensing assembly 156, or other intermediate component, to minimize fasteners and permit tool-free installation. In some example embodiments, alignment extensions 332 may be ribs, tabs, or shoulders that limit insertion depth along transverse direction T, prevent rotational misplacement in the plane of the base plate 302, and/or provide a snap detent to resist uncoupling under vibration. Opening 334 defined by attachment component 330 is dimensioned and positioned to overlay a corresponding port of dispensing assembly 156 or intermediate component. In some example embodiments, a compressible seal (not shown) may be disposed around opening 334 to ensure an airtight junction with the dispensing assembly 156 or intermediate component. In some example embodiments, alignment extensions 332 may serve primarily as structural support for the blower assembly 300 to prevent vibrational movement, e.g., rattling, and to decrease wear on base plate 302 and the blower assembly 300 generally.

FIGS. 5 and 6 illustrate additional details of base plate 302. In some example embodiments, base plate is a plastic. In another example embodiment, base plate 302 is a molded polymer. Base plate 302 may integrally form one or more of locating pin 306, locating knob(s) 308, attachment component 330, blower cover 304, and alignment extensions 332 as a part of base plate 302 to reduce part count and additive tolerance stacks. In some example embodiments, base plate 302 may be a stamped or formed metal plate with separately affixed locating pin 306, locating knob(s) 308 (e.g., riveted, swaged, or welded studs), etc. In another example embodiment, blower cover 304 may be a separate component that is attached to base plate 302 via hinges, snap tabs, or mechanical fasteners.

Assembly of blower assembly 300 is straightforward and repeatable. With base plate 302 secured to dispensing assembly 156, or other intermediate component, via attachment component and possibly alignment extensions 332, blower fan 310 is installed by first inserting locating pin 306 into its corresponding one of the plurality of mounting apertures 314. With the locating pin 306 seated, blower fan 310 is then rotated about locating pin 306 until each locating knob 308 extends partially into its respective mounting aperture 314. This motion simultaneously urges blower fan 310 into intimate contact with base plate 302 and aligns exhaust port 312 within blower cover 304 for a rattle-free fit. In some example embodiments, Blower cover 304 is then closed or fastened to base plate 302 (when blower cover 304 is a separate component and not integrally a part of base plate 302), and due to the tapered angle 328, the cover-to-fan interference is established to complete the air seal. In some example embodiments, no additional tools are required beyond a single fastener or latch for blower cover 304 (or none if blower cover is a part of base plate 302).

During operation, blower fan 310 draws ambient or cabinet air and discharges through exhaust port 312 into blower cover 304, which directs the flow through the opening 334 of attachment component 330 into the cabinet, and particularly the dispensing assembly 156. This directed airflow can, for example, reduce retained moisture near a detergent drawer, purge volatile odors, or maintain a controlled humidity near chemical dispensers during operation or between cycles. Because the locating pin 306 and the at least one locating knob 308 prevents movement of the blower fan in the vertical direction V and lateral direction, and the interference created between the blower fan 310 and blower cover 304, long-term positional stability is maintained despite thermal cycling and vibration.

Although FIGS. 5 through 8 illustrate a plurality of locating knobs 308 near bottom edge 322, any count of at least one locating knob 308 may be used including one, two, or three or more knobs. In some example embodiments, the at least one locating knobs 308 may be circumferentially distributed on base plate 302 around exhaust port 312 to resist off-axis vibration modes. In this regard, the blower fan 310 would have mounting apertures 314 corresponding to each locating knob 308. Further, locating pin 306 may be cylindrical, D-shaped, or keyed. A keyed locating pin 306 and reciprocal mounting aperture 314 pair may enforce a single assembly orientation to avoid misalignment of the exhaust port 312 relative to the blower cover 304.

Although blower assembly 300 is shown as an auxiliary unit directed to dispensing assembly 156 in a combination wash and condenser dryer appliance 100, the same locating architecture (locating pin 306 and at least one locating knob 308) may be deployed in other blower assemblies in other appliances. Non-limiting examples include a dishwashing appliance wherein a blower assembly may be coupled to a drying duct to deliver air across utensils or inner door surfaces, a refrigerator appliance wherein blower assembly directs air through a deodorizing or humidity-control plenum, a standalone dryer appliance wherein blower assembly provides a localized purge flow to a lint management subassembly, or other appliances having subassemblies that benefit from precise, blower alignment and sealing.

As explained herein, aspects of the present subject matter are generally directed to a blower assembly for an appliance, e.g., a combination washer/dryer laundry appliance. For example, the blower assembly may have locating features, e.g., locating pin and at least one locating knob, present on the base plate to ensure a proper alignment of the blower fan's exhaust port with the blower cover. As previously mentioned, although described in the context of a laundry appliance, the presently presented blower assembly embodiments may be deployed in any appliance that utilizes a blower. In some appliances, this blower assembly acts as an auxiliary blower assembly and may be directed at specific sub-assemblies, such as the dispensing assembly. This allows for concentrated blower focus on a particular portion of the appliance without diverting or repurposing the primary or main blower fan. Further, the locating features presented herein provide an opportunity to reduce part count, decrease assembly time, and tighten tolerances during manufacturing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A blower assembly for an appliance, the appliance defining a mutually orthogonal vertical direction, lateral direction, and transverse direction, the blower assembly comprising:

a base plate;

a blower cover attached to the base plate;

a locating pin extending from the base plate;

at least one locating knob extending from the base plate; and a blower fan comprising an exhaust port and defining a plurality of mounting apertures, wherein each of the plurality of mounting apertures are configured to receive one of the locating pin or the at least one locating knob respectively therein to align the exhaust port with the blower cover, wherein an internal top plane of the blower cover and an internal bottom plane of the blower cover define a tapered angle, wherein the tapered angle of the internal top plane is greater than the tapered angle of the internal bottom plane, and wherein the tapered angle of the internal top plane creates an interference with a top surface of the blower fan.

2. The blower assembly of claim 1, wherein the exhaust port of the blower fan is positioned within the blower cover.

3. The blower assembly of claim 1, wherein the locating pin is positioned on a lateral edge of the base plate opposite that of the blower cover, wherein the locating pin prevents the movement of the blower fan in the vertical direction, and wherein the locating pin serves as a pivot point for the blower fan.

4. The blower assembly of claim 3, wherein the at least one locating knob is positioned near a bottom edge of the base plate, wherein each of the at least one locating knob extend partially into each respective mounting aperture of the plurality of mounting apertures.

5. The blower assembly of claim 4, wherein the at least one locating knob is positioned within their respective mounting aperture of the plurality of mounting apertures by rotating the blower fan about the locating pin.

6. The blower assembly of claim 5, wherein the at least one locating knob is generally semi-circle shaped.

7. The blower assembly of claim 1, further comprising:

an attachment component extending from a rear of the base plate.

8. The blower assembly of claim 7, wherein the attachment component is configured to be coupled to a dispensing assembly for the appliance.

9. A laundry appliance defining a mutually orthogonal vertical direction, lateral direction, and transverse direction, the laundry appliance comprising:

a tub positioned within a cabinet;

a wash basket rotatably mounted within the tub, the wash basket defining a chamber for receipt of articles for washing and drying;

a dispensing assembly positioned near a top of the cabinet; and a blower assembly coupled to the dispensing assembly, the blower assembly comprising:

a base plate;

a blower cover attached to the base plate;

a locating pin extending from the base plate;

at least one locating knob extending from the base plate; and a blower fan comprising an exhaust port and defining a plurality of mounting apertures, wherein each of the plurality of mounting apertures are configured to receive one of the locating pin or the at least one locating knob respectively therein to align the exhaust port with the blower cover, wherein an internal top plane of the blower cover and an internal bottom plane of the blower cover define a tapered angle, wherein the tapered angle of the internal top plane is greater than the tapered angle of the internal bottom plane, and wherein the tapered angle of the internal top plane creates an interference with a top surface of the blower fan.

10. The laundry appliance of claim 9, wherein the exhaust port of the blower fan is positioned within the blower cover.

11. The laundry appliance of claim 9, wherein the locating pin is positioned on a lateral edge of the base plate opposite that of the blower cover, wherein the locating pin prevents the movement of the blower fan in the vertical direction, and wherein the locating pin serves as a pivot point for the blower fan.

12. The laundry appliance of claim 11, wherein the at least one locating knob is positioned near a bottom edge of the base plate, wherein each of the at least one locating knob extend partially into each respective mounting aperture of the plurality of mounting apertures.

13. The laundry appliance of claim 12, wherein the at least one locating knob is positioned within their respective mounting aperture of the plurality of mounting apertures by rotating the blower fan about the locating pin.

14. The laundry appliance of claim 13, wherein the at least one locating knob is generally semi-circle shaped.

15. The laundry appliance of claim 9, the blower assembly further comprising:

an attachment component extending from a rear of the base plate.

16. The laundry appliance of claim 15, wherein the blower assembly is coupled to the dispensing assembly via the attachment component.

* * * * *